US005819368A

United States Patent [19]

Wang et al.

[11] Patent Number: 5,819,368

[45] Date of Patent: Oct. 13, 1998

[54] METAL COLLECTION DEVICE FOR VACUUM CLEANERS

[75] Inventors: Chieh-Chun Wang; Chia-Ming Lin, both of Taichung, Taiwan

[73] Assignee: Kinergy Industrial Co., Ltd., Taichung, Taiwan

[21] Appl. No.: 865,122

[22] Filed: May 30, 1997

[51] Int. Cl.[6] ..... A47L 9/00

[52] U.S. Cl. ..... 15/339; 15/337; 15/350

[58] Field of Search ..... 15/339, 347, 350, 15/351

[56] References Cited

U.S. PATENT DOCUMENTS

| | | | |
|---|---|---|---|
| 2,677,461 | 5/1954 | Bodey | 15/399 X |
| 4,759,095 | 7/1988 | Hoy | 15/339 |
| 4,893,376 | 1/1990 | Sunagawa et al. | 15/344 X |
| 5,400,465 | 3/1995 | Bosses et al. | 15/339 |

FOREIGN PATENT DOCUMENTS

| | | | |
|---|---|---|---|
| 1484856 | 5/1967 | France | 15/339 |

*Primary Examiner*—Chris K. Moore
*Attorney, Agent, or Firm*—Bacon & Thomas

[57] ABSTRACT

This invention concerns a Metal Collection Device for Vacuum Cleaners. It consist of a cover structure (that could be opened) that is attached to the soft tube of the vacuum cleaner. The interior of this cover structure has a strong magnet which attracts the metal items sucked in by the vacuum cleaner. This prevents the metal items from entering the main body of the vacuum cleaner and thereby prevents damage to the internal components or to the collection bag. When the need arises to clean or remove the metal items collected by the magnet, the cover structure could be opened and the magnet, along with the metal items collected by it, removed. Thus providing extreme ease of usage.

1 Claim, 4 Drawing Sheets

METAL COLLECTION DEVICE FOR VACUUM CLEANERS

DETAILED DESCRIPTION OF THE INVENTION

This invention concerns a Metal Collection Device for Vacuum Cleaners. It consist of a cover structure (that could be opened) that is attached to the soft tube of the vacuum cleaner. The interior of this cover structure has a string magnet which attracts the metal items sucked in by the vacuum cleaner. This prevents the metal items from entering the main body of the vacuum cleaner and thereby prevents damage to the internal components or to the collection bag. Therefore, the useful life of the vacuum cleaner is prolonged.

Accordingly, a normal upright vacuum cleaner utilizes the brush wheel at its flat bottom or its suction extension to clean up rugs or other items such as containers. The dust or waste is sucked into the flat bottom and is sent through the soft tube to the collection bag in the upright body of the vacuum cleaner. Thus, the vacuum achieves its purpose of cleaning and collecting dust.

However, due to the reason that the vacuum cleaner is powerful in its suction, often, metal items are sucked in as well. These may include stationary, screws, mini lighters and etc. Although these small items may not cause excessive damage to the components of the vacuum cleaner, as a result of their impact they may penetrate the plastic soft tube or other related components which may lead to the lowering of the efficiency of the vacuum cleaner. These items may well destroy the collection bag. This will lead to dust and other wastes flying all around the interior of the vacuum cleaner which is a serious matter of pollution.

Therefore, the inventor, in view of the above situation, engaged in research to develop an improvement, with many years of professional experience and the spirit to pursue advancement, which is the Metal Collection Device for Vacuum Cleaners. It consist of a cover structure (that could be opened) that is attached to the soft tube of the vacuum cleaner. The interior of this cover structure has a strong magnet which attracts the metal items sucked in by the vacuum cleaner. This prevents the metal items from entering the main body of the vacuum cleaner and thereby prevents damage to the internal components or to the collection bag. This is the main purpose of this invention.

DESCRIPTION OF THE DRAWINGS

The design and functions for this invention to achieve its purpose and structure is described in the following diagrams.

Figure 1:
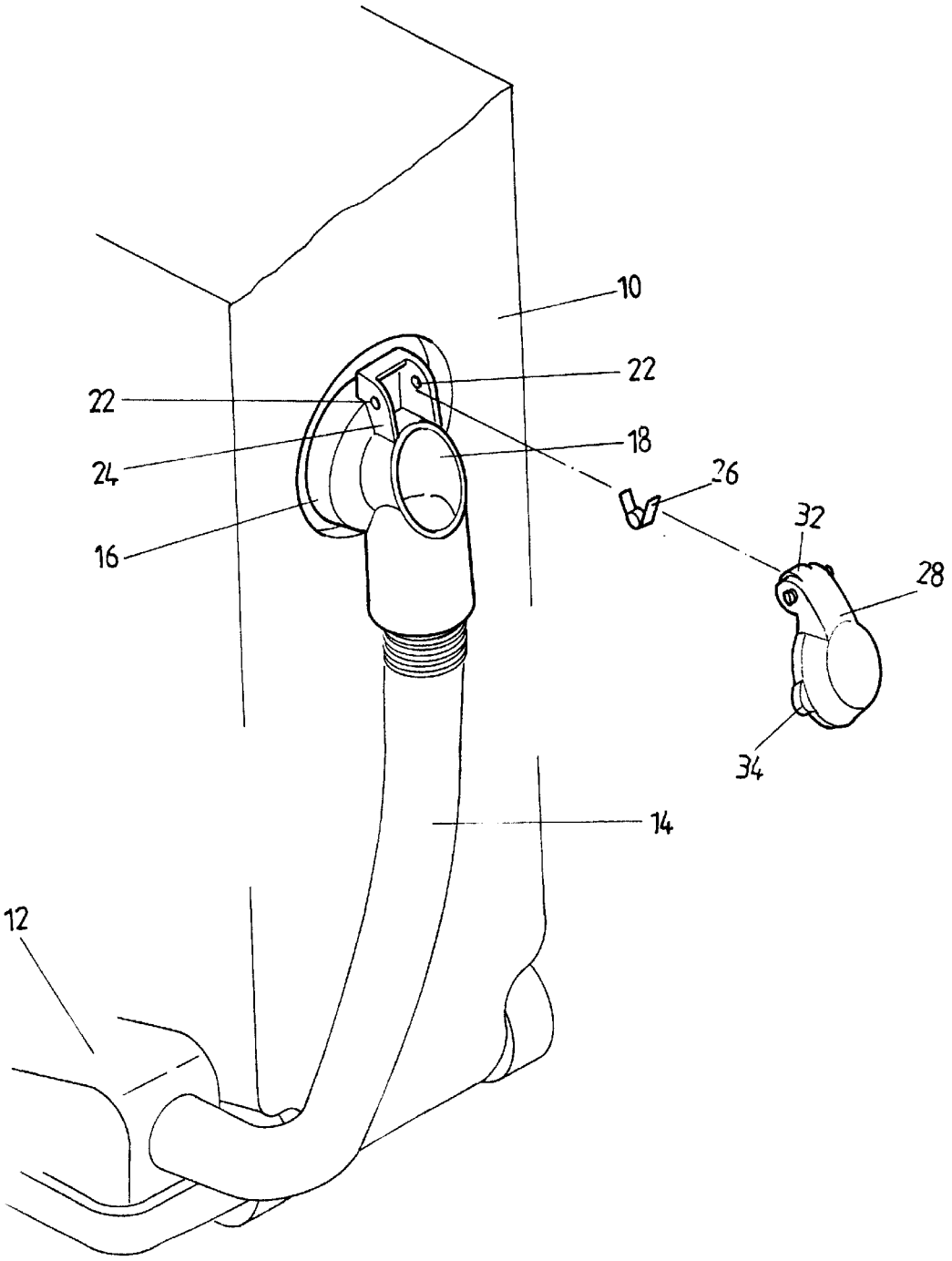
FIG. 1: Disassembled 3-D Diagram of the invention.
Figure 2:
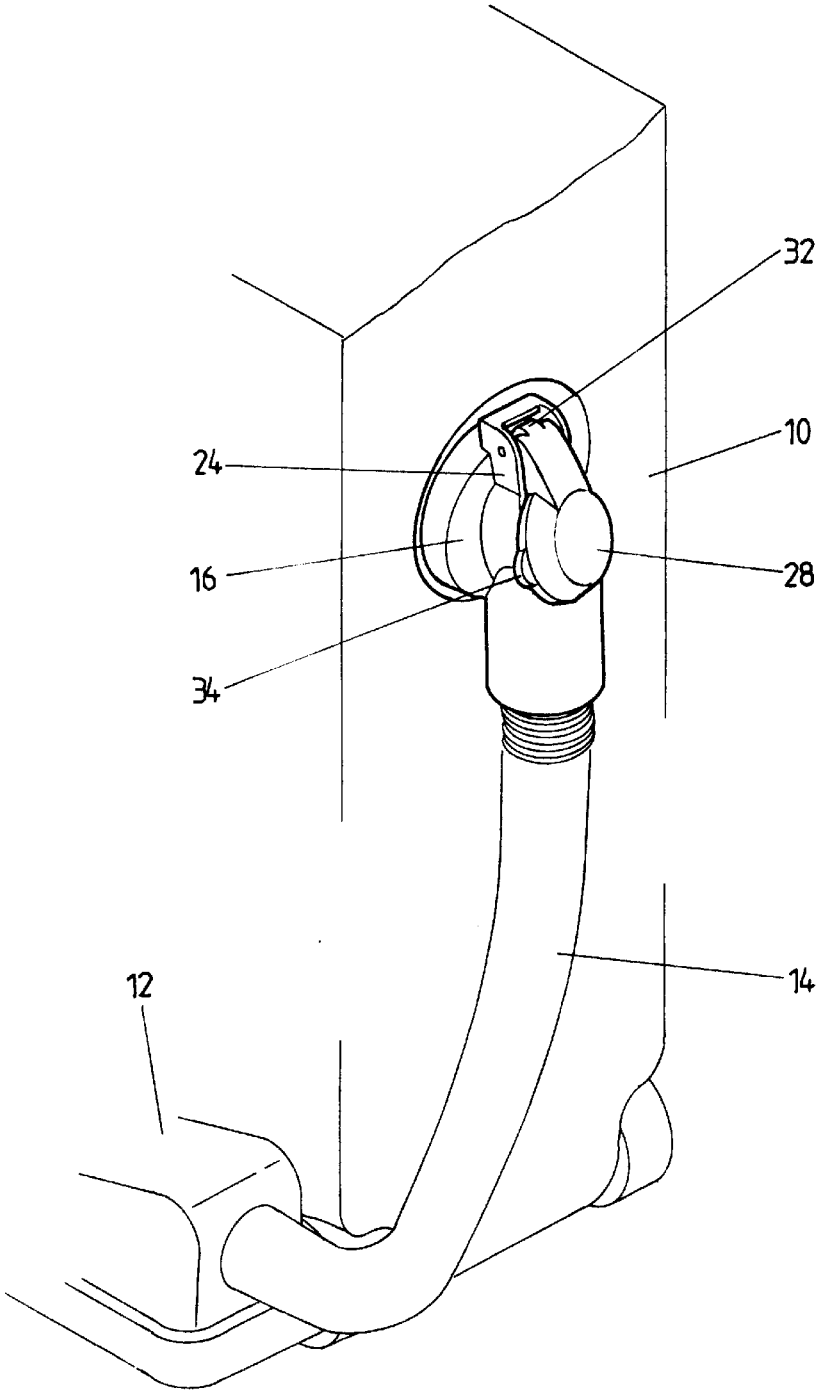
FIG. 2: Assembled 3-D Diagram of the invention.

Firstly, reference is made to FIGS. 1 and 2. The normal vacuum cleaner consists of an upright and a flat structure. The upright structure has within it, an air pump (not shown) connecting to the soft tube at the back side of the vacuum cleaner and to the flat structure. Therefore, when the suction opening of the brush wheel in the flat body (not shown) or when the suction extension (not shown) sucks in dust or wastes, these are sent through the soft tube to the collection bag (not shown) inside the upright body. This completes the cleaning process.

Figure 3:
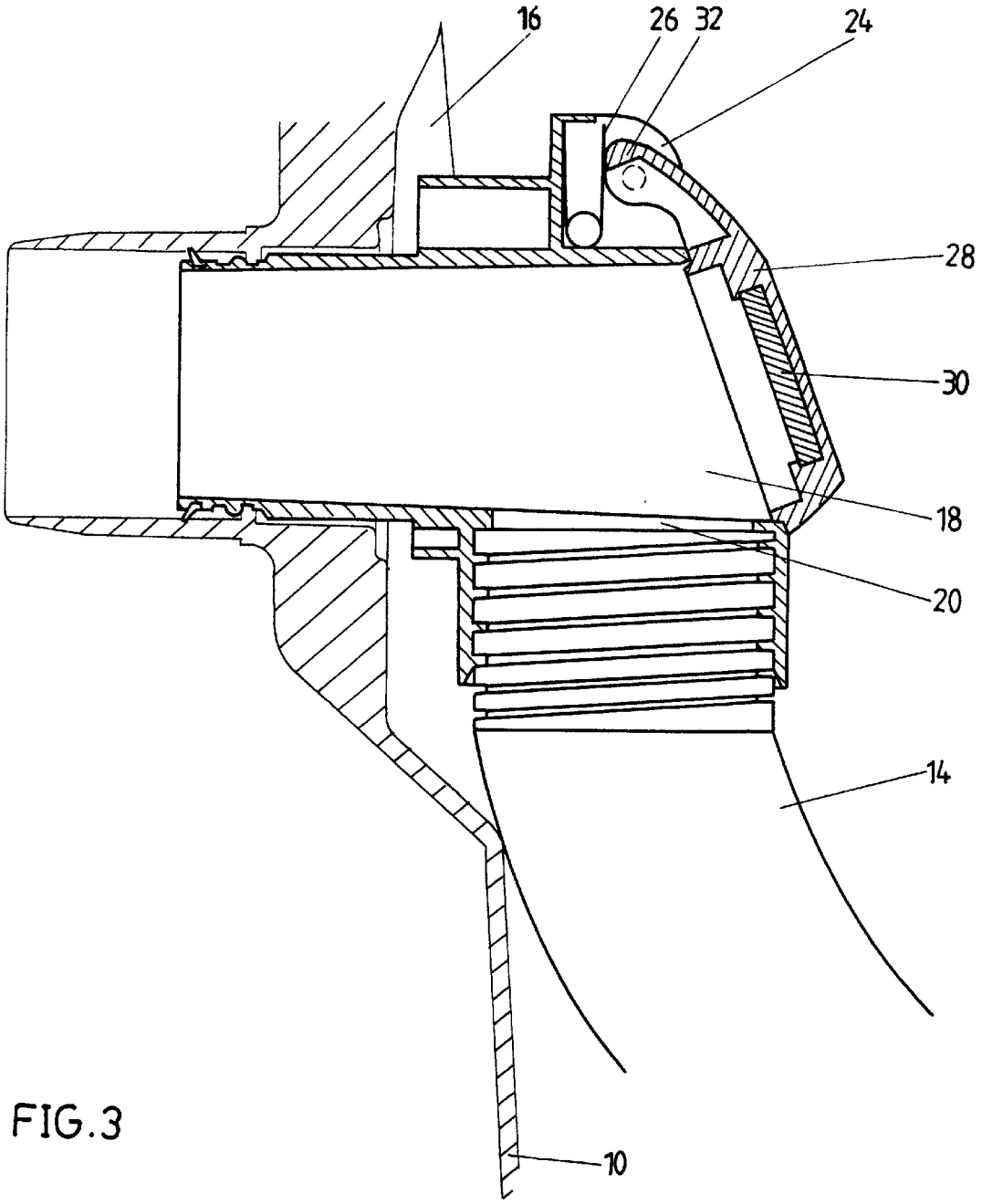
FIG. 3: Dissected Combination Diagram of an example of the invention.

As shown in the figures, a horizontal penetrating member having a hole or opening on the outside thereof is positioned at the connector of the soft tube at the back side of the Vacuum cleaner. The penetrating member forms a connection with the air hole. The top of the penetrating member contains an ear portion for holding a U-shaped spring which urges against a cover flap. The cover flap covers the exterior of the outside hole of the penetrating member. As shown in FIG. 1 and 3, a strong magnet is located within the cover flap. The magnetic force collects the metal items which are sucked in through the soft tube. This prevents the metal items from entering the main body of the vacuum cleaner, and thereby prevents damage to the internal components or to the collection bag of the vacuum cleaner.

The U-shaped spring has two legs. One leg of the spring is supported against the inside of the ear portion of the penetrating member. Its other leg is supported against a protruding portion of the cover flap so that the spring urges against the cover flap thereby providing spring force to maintain the cover flap against the outside hole of the penetrating member.

Figure 4:
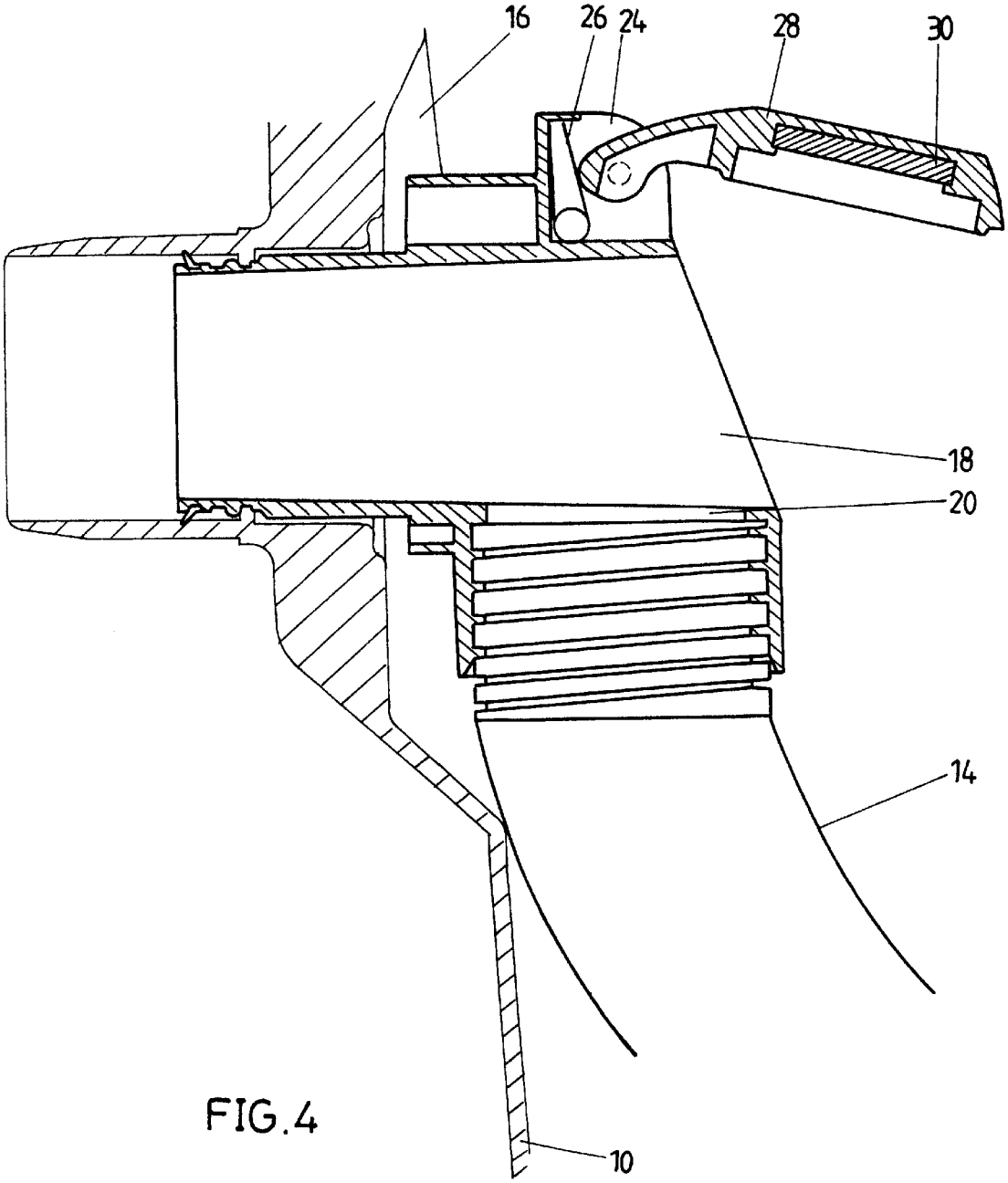
FIG. 4: Diagram of Usage Illustration of the Invention

The cover flap contains an ear or projection on either side thereof. When the need to clean the collected metal items arises, the cover flap may be lifted by grabbing the projections located at the two sides of the cover flap. At this time, the outside hole of the penetrating member is exposed (as shown in FIG. 4). The user may be able to clean up the collected metal items. The open state of the cover flap also allows users to make connection to other extensions. The inventor has separately applied for patent on this issue and so will not elaborate further on this area of matter.

The above description refers to the more practical usage of this invention. It does not, at all, limit the scope of use for this invention in its patent application. Therefore, all usage of this invention and the structural changes as shown in the description of the manual and its illustrative contents are all under the scope of the patent of this invention. In view of the description of this invention, it is apparent that it is original, innovative and practical. In addition, the invention has not been published nor are there any related forms of inventions. This fully complies with the requirements of a new patent.

In view of the description of this invention, it is apparent that it is original, innovative and practical. It improves on the deficiencies of the traditional horizontal instrument of measure. This fully complies with the requirements of a new patent. Therefore, the application for patent is requested.

What is claimed:

1. A metal collection device for a vacuum cleaner which comprises a penetrating member with a tube extending therethrough; said tube having two ends, one end being adapted for connection with an air hole of a vacuum cleaner and the other end being adapted for connecting with a soft tube of a vacuum cleaner, whereby air passes from said soft tube through said penetrating member and into said air hole when said device is connected to the vacuum cleaner; said penetrating member containing an opening which extends into the tube of said penetrating member; a cover flap which covers said opening and a spring which maintains said cover flap in a closed position over said opening; said cover flap including a magnet to collect metal items which pass through the tube of the penetrating member when the cover flap is closed and the vacuum cleaner is being operated; and means for opening said cover flap to retrieve said metal items from said magnet.

* * * * *